United States Patent [19]

Jones, Jr.

[11] 4,120,189

[45] Oct. 17, 1978

[54] PULLING HOOK APPARATUS

[76] Inventor: Garland Jones, Jr., Rt. 1, Box 841, Conroe, Tex. 77301

[21] Appl. No.: 812,579

[22] Filed: Jul. 5, 1977

[51] Int. Cl.[2] ..... B21D 1/12

[52] U.S. Cl. ..... 72/457; 24/230.5 R; 294/82 R; 72/705

[58] Field of Search ..... 72/705, 457; 248/304, 248/316 A; 24/230.5 R; 294/82 R, 85; 81/3 R, 421, 422, 423, 425 R, 180 B, 180 R; 254/133, 134; 29/401 B

[56] References Cited

U.S. PATENT DOCUMENTS

| | | | |
|---|---|---|---|
| 886,241 | 4/1908 | Norton | 24/230.5 R UX |
| 1,045,882 | 12/1912 | Price | 24/230.5 R |
| 2,140,686 | 12/1938 | Bennett | 72/705 X |
| 2,482,738 | 9/1949 | Smith | 72/705 X |
| 2,531,422 | 11/1950 | Gerum | 24/230.5 R |
| 2,616,317 | 11/1952 | Hakkerup | 72/705 X |
| 2,651,539 | 9/1953 | Poisal | 294/82 R |
| 2,660,349 | 11/1953 | Bernau | 24/230.5 R X |
| 2,939,507 | 6/1960 | Miller | 72/705 X |
| 3,247,742 | 4/1966 | Woodbury | 81/180 B X |
| 3,338,086 | 8/1967 | Hunter | 72/705 X |
| 3,760,625 | 9/1973 | Archambault | 72/705 X |
| 3,808,870 | 5/1974 | Blancett | 81/423 X |

*Primary Examiner*—C.W. Lamham
*Assistant Examiner*—D. M. Gurley

[57] ABSTRACT

A new and improved pulling hook apparatus for straightening and bending automobile frames and bodies wherein the hook is formed having a longitudinal handle portion with a hook pulling portion at one end and an eye connecting portion at the other end and including a pulling plate member having a greater size than the hook pulling portion for removably mounting on the hook pulling portion to increase the work engaging surface of the hook to apply the force over a larger surface area of a work piece.

7 Claims, 3 Drawing Figures

PULLING HOOK APPARATUS

BACKGROUND OF THE INVENTION

This invention relates generally to the field of tools for straightening and bending automobile frames, bodies, and the like.

With the increased number of motor vehicles operating on the roads and highways, there has also been an increase in the number of accidents involving damage to these vehicles. Since the cost of repairing these vehicles may generally be less than the replacement of the vehicle with a new one, it has been the practice in the past to repair damaged vehicles and replace them in their original working order. This damage may be limited to sheet metal damage, such as dents in fenders and doors and the like, and numerous tools have been devised to facilitate such work. Known U.S. Patents for repairing and removing dents in sheet metal are as follows: Nos: 2,464,118; 2,527,725; 3,066,719; 3,100,336; 3,486,481; 3,570,289; 3,611,784; 3,728,891; and 3,765,220. The concentration of too much pulling force on a small area of sheet metal and even heavy frame and structural members can cause tearing and over-bending at that area.

In addition to sheet metal damage, serious accidents also result in damage to structural or frame members of an automobile body which members require very large amounts of force to straighten and bend back to their original position. Known U.S. Patents disclosing pulling systems are: U.S. Pat. Nos. 3,589,680; 3,745,809; and 3,817,081. Because of the large amounts of force necessary to bend or straighten such frame members, problems arise when too much force is applied to a particular point which may cause tearing or buckling of the frame member at that point. Also, it may be difficult or impossible to position a tool having a very large work engaging surface due to limited access to a damaged area. There has been a need in the field of body repair for a tool which will function under many situations and eliminate the need for many different types of tools which are costly and may have limited uses.

SUMMARY OF THE INVENTION

This invention relates to a new and improved pulling hook apparatus for straightening body and frame members of motor vehicles, wherein the hook includes a handle portion having an eye portion and a hook pulling portion. The apparatus includes an interchangeable pulling plate member having substantially greater work engaging face portions than that of the hook portion with the plate member having an opening therein for receiving and removably retaining the hook portion and handle portion to increase the work engaging area and avoid damage to work pieces during use. The hook and eye are oriented relative to the handle portion so that a line of force through the pulling contact point on the eye resulting from a direct pull intersects the point of junction of the hook portion with the handle portion to substantially prevent slippage of the hook from a work piece during use.

DESCRIPTION OF THE PREFERRED EMBODIMENT

The pulling hook apparatus A of this invention includes a hook member H having a longitudinally extending handle portion 10, an eye portion 11 and a hook pulling portion 12 and a plate member P. The eye portion 11 includes an opening O defined by the wall surface 13 with the opening O being generally egg-shaped. The opening O includes a contact point **13*a* which is at a point farthest from the hook portion 12 and which engages a conventional connector member (not shown) or the like of a conventional pulling system insertable through the opening O for applying a pulling force to the hook member. The connecting member, which is inserted in the opening O, may itself include a type of hook, such as a J-hook or the like, which will engage the contact point 13*a*** when applying a pulling force thereto.

The wall surface 13 includes two surface portions **13*b* and 13*c* which taper toward the contact point 13*a*. Accordingly, when a pulling force is applied to a connector member inserted in the opening O, a portion of the member engaging either or both of the surfaces 13*b* or 13*c* will be directed by the action of such camming surfaces 13*b* and 13*c* to the pulling member contact point 13*a***.

Figure 3:
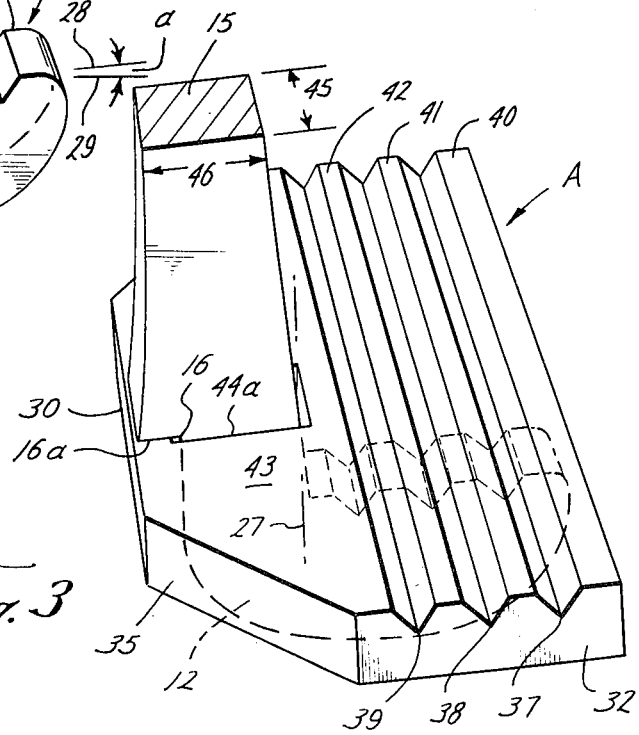
FIG. 3 is a perspective view and side elevation with the portion of the pulling hook broken away and showing the pulling hook mounted with the pulling plate.

An enlarged connecting portion 14 joins the eye portion 11 and handle portion 10 and includes a larger portion compared to the cross-section of the handle portion 10. As best shown in FIG. 3, the handle portion 10 narrows to a point locus or minimum a cross-section 15 which shows the smallest size of the hook member H indicated by the width 45 and height 46. A notched or stepped portion 16 is provided where the handle portion 10 joins the hook portion 12 for a purpose as explained hereinafter. The notched or stepped portion 16 results in an immediate reduction in cross-sectional area of the handle portion. At 16 the cross-sectional area of the handle is at least as large as the minimum area 15.

The hook portion 12 is generally semicircular in configuration as viewed from the side and includes a curved convex outer wall portion 17 having a predetermined radius of curvature for a purpose as also explained hereinafter. The hook portion 12 includes a work engaging surface 18 which includes a plurality of V-shaped indentions or serrations 19, 20, and 21 to facilitate nonslip gripping of a work piece and a plurality of work engaging contact surfaces 22, 23, 24, and 25 which are planar along line 28. The work engaging contact surface 25 joins the handle portion 10 at edge 26. The hook portion 12 is oriented relative to the handle portion 10 and the opening O such that the pulling force exerted on the eye portion 11 creates a direct line of force 27 which extends directly from the contact point **13*a* to the edge 26 of surface 18. Accordingly, when a pulling force is applied at or near the contact point 13*a*, the pulling force will be directed along imaginary line 27 so as to preferably void any force component to the left relative to FIG. 1 which might tend to slip or slide the hook portion 12 off of any object which is receiving the pulling force through the work engaging surface 18. This is achieved by having the plane of the work engaging contact surfaces 22, 23, 24, and 25, as shown by the line 28, at a slight angle to the line 29 which is generally perpendicular to the line of force 27**. The angle "*a*" preferably may be in the order of a few degrees, which may be about 2–5°, so as to provide this result. This reduces the effects of transverse pulling forces that act to create a moment which would tend to pull or slide the face 18 off a work piece.

Figure 1:
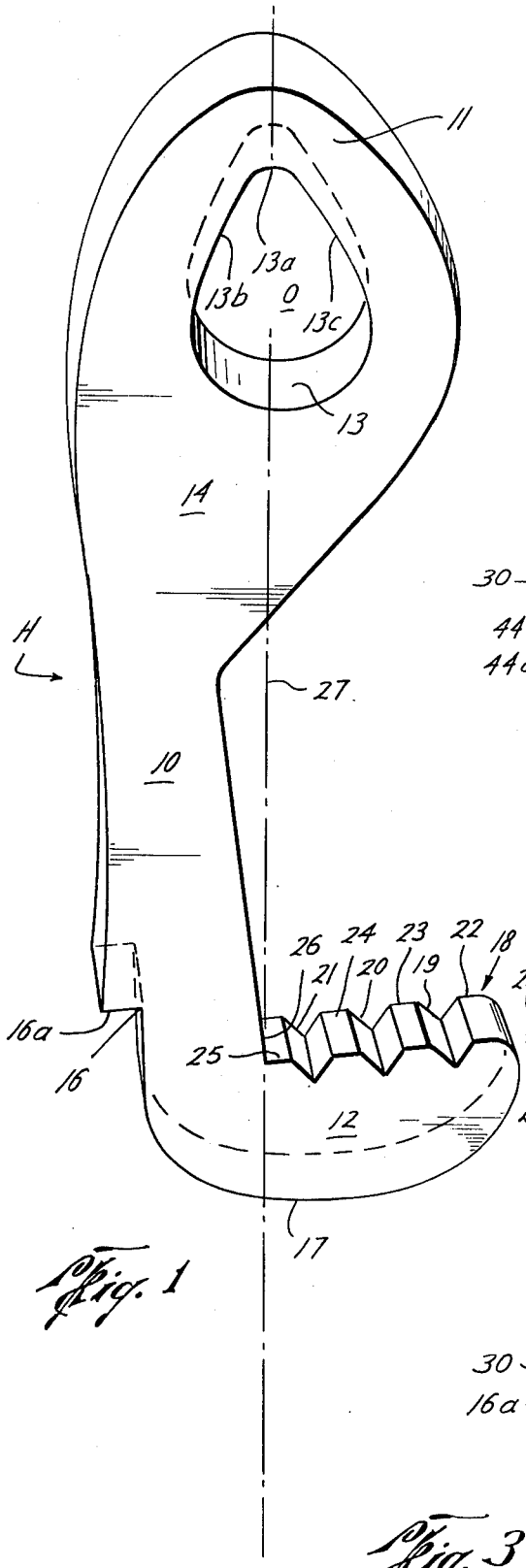
FIG. 1 is a perspective view in elevation of the pulling hook of this invention.
Figure 2:
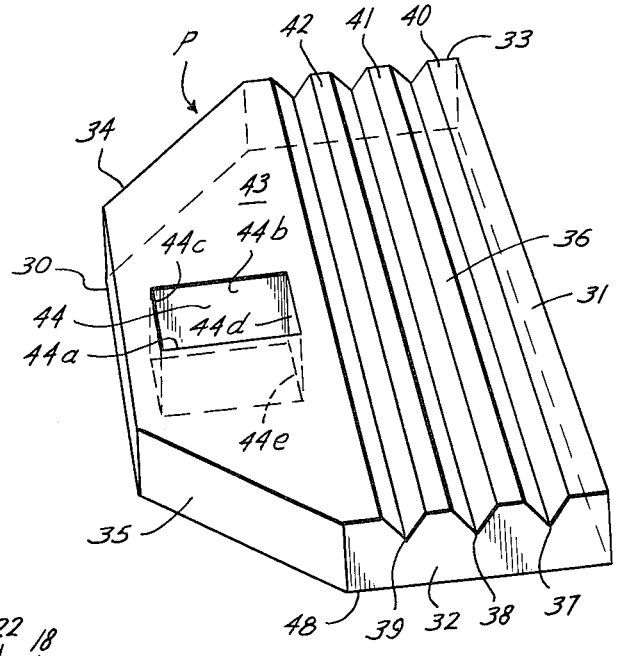
FIG. 2 is a perspective elevation view of the pulling plate of this invention.

A pulling plate member P which is used in combination with the hook 11 is shown in FIG. 2 of the drawing. The pulling plate member P is preferably of polygonal shape and is shown in FIG. 2 as being hexagonal. The pulling plate member P includes an lower surface 30, upper surface 31, side surfaces 32 and 33, and angled surfaces 34 and 35. The plate member P also includes a working engaging surface or face 36 which, as shown in FIG. 2, is significantly greater in area than the work engaging surface 18 of the hook member H. The work engaging face portion 36 includes a plurality of generally V-shaped serrations or indentions 37, 38, and 39 to prevent slipping of the tool from a work piece in the same manner as the serrations 19, 20, and 21. The work engaging contact surfaces 40, 41, 42, and 43 are provided for engaging a work piece which is being pulled with the hook member H and plate member P. As best shown in FIG. 3, the hook member H is adapted to be inserted in a rectangular opening 44 in the plate member P. The sidewalls **44*a* and 44*b*, as shown in FIG. 2, are slightly farther apart than the thickness 45 of the hook member, as shown in FIG. 3, so as to allow ease of insertion of the hook portion 12 through the opening 44. Top wall 44*c* and bottom wall 44*d* further define the opening 44 and the distance between the top and bottom walls is such that the hook portion 12 may be inserted through the opening 44 as shown in FIG. 3. The clearance between the top and bottom walls and the hook member as opposed to the clearance between the sidewalls 44*a* and 44*b* is greater to facilitate insertion of the widest part of hook portion 12 through the opening. The curved outer wall portion 17 has a radius of curvature defining the width (the distance between the surface 17 and the contact faces 22, 23, and 24) of the hook portion 12 which allows insertion of the hook portion in the opening and rotation of the hook when inserted in the opening until the work engaging face portion 18 engages the rear wall 48 of the pulling plate member P. The wall surface 16*a*, as shown in FIG. 1 formed by the notched out portion 16, engages the upper edge of the work engaging contact surface 43 as best shown in FIG. 3. Although the pulling plate member P is shown as hexagonal in shape, it is understood that other shapes for the pulling plate member could be used. Different sized pulling plate members having varying sizes of work engaging contact surfaces would be provided to increase the versatility of the hook member H. Since the thickness of the pulling plate member P (distance from the work engaging contact surface to the rear face 48) is uniform, the pulling plate member is at the same angle as the plane of the work engaging contact surfaces 22, 23, 24, and 25 such that the line of force 27 tends to retain the pulling plate member P on the work piece which is being pulled. The rear edge 44*e* of the bottom wall 44*d* engages the edge 26 where the pulling hook portion connects with the handle portion 10. During a normal straight pull, the handle member 10 will be held firmly in position with the work engaging surfaces of the hook engaging the back portion of the plate member and the surface 16*a* firmly engaging the surface 43 so as to distribute the pulling forces of the pulling hook portion 12** on the plate member P.

The pulling hook member and plate member P of this invention can be used on any of the numerous standard pulling systems which are generally used in automotive and truck body work. In some applications, the pulling plate member having the desired work engaging surface area may be inserted upon the hook member H as shown in FIG. 3 so as to appreciably increase the area of the work engaging surface 18 such that the pulling force is distributed to the much larger area contacted by the work engaging base portions 40, 41, 42, and 43 and serrations 37, 38, and 39. Accordingly, this enables pulling a bent member to a desired portion without buckling or crinkling the member which can result from the subjection of the body member or the like being straightened to too great a pulling force over too small an area. Even with relatively thin members, it is desirable to distribute the pulling force over a larger amount of area which is possible using the desired size pulling plate member in combination with the hook member. The ease of removal of the pulling plate member P allows the insertion of other pulling plate members of varying sizes, as is required in particular applications. While it would be possible to form hook members with varying sizes of work engaging face portions, this would require numerous hook members, thus increasing the cost.

In some applications, it may be impossible to insert the hook member and plate member in position with the plate member mounted on the hook member due to limited access to the location where it is required to make a pull. In this case it would be possible to insert the hook member adjacent the surface to be pulled and then slip the plate member over the hook member. This would be required where there was limited access to the portion on the member which it was desired to apply a pull. The hook portion 12 could be inserted through an opening or access in the member being pulled with the opening having a size at least as great as the opening 44 and then the plate member could be attached to the hook from the side of the surface to be engaged by the plate member to increase the work engaging surfaces area so as to evenly distribute the forces exerted on the work piece during bending or pulling operations. This has application on sheet metals, such as body members as well as very strong structural members, such as frames and support pillars. A plate member having a desired size would be selected so as to distribute the pulling force over a maximum area or over a particular area in order to obtain the desired bending of the work piece.

The foregoing disclosure and description of the invention are illustrative and explanatory thereof, and various changes in the size, shape, and materials as well as in the details of the illustrated construction may be made without departing from the spirit and scope of the invention.

What is claimed is:

1. An all-purpose pulling hook apparatus for straightening or and bending automobile parts with a pulling device, comprising:

a hook member comprising a longitudinally extending handle portion having an eye portion at one end thereof for attaching to the pulling device and having a hook pulling portion at the other end thereof for engaging the automobile parts;

said hook member having a connection point wherein said hook pulling portion connects with said handle portion of said hook member;

said eye portion having a pulling contact point adjacent said end of said hook member;

said hook pulling portion including a hook pulling member having a work engaging surface extending at about a right angle from said handle portion;

a pulling plate member having a work engaging surface of greater size than said work engaging surface of said hook pulling member, said pulling plate member having an opposed plate member back surface;

said pulling plate member having an opening therein for receiving and removably retaining said handle portion with said work engaging surface of said hook pulling portion contacting said opposed plate member back surface of said pulling plate member;

said eye portion and said hook pulling portion are positioned so that a straight pull on said hook member by the pulling device results in a force line that substantially intersects with said connection point and said pulling contact point to facilitate firm engagement with the automobile parts to be straightened or bent; and, wherein the plane of said work engaging surface of said hook pulling member is oriented at a slight acute angle to a perpendicular to said force line in the direction of said eye portion to prevent slippage of said pulling plate member from the automobile parts to be straightened or bent under a pulling load.

2. The apparatus as set forth in claim 1, wherein:

said eye portion has a generally egg-shaped opening.

3. The apparatus as set forth in claim 1, wherein:

said work engaging surface of said hook pulling member has a plurality of transverse serrations to facilitate gripping said pulling plate member.

4. The apparatus as set forth in claim 1, wherein:

said work engaging surface of said pulling plate member has a plurality of transverse serrations to facilitate gripping the automobile parts to be straightened or bent.

5. The apparatus as set forth in claim 1, wherein:

the opening in the pulling plate member in generally rectangular.

6. The apparatus as set forth in claim 1, wherein:

said handle portion includes a notched out portion which engages said work engaging surface of said pulling plate member when said work engaging surface of said hook pulling portion contacts said opposed plate member back surface.

7. The apparatus as set forth in claim 1, wherein:

said hook pulling portion has an outer wall portion opposing said work engaging surface; and said outer wall portion having a radius of curvature allowing the insertion and positioning of said hook pulling portion in said opening in said pulling plate member.

* * * * *